US007300265B2

(12) United States Patent
Stover

(10) Patent No.: US 7,300,265 B2
(45) Date of Patent: Nov. 27, 2007

(54) FLANGED SLEEVE GUIDE

(75) Inventor: Christopher Stover, Versailles, OH (US)

(73) Assignee: Emerson Climate Technologies, Inc., Aidney, OH (US)

( * ) Notice: Subject to any disclaimer, the term of this patent is extended or adjusted under 35 U.S.C. 154(b) by 73 days.

(21) Appl. No.: 11/224,711

(22) Filed: Sep. 12, 2005

(65) Prior Publication Data

US 2007/0059192 A1 Mar. 15, 2007

(51) Int. Cl.
*F04C 18/00* (2006.01)

(52) U.S. Cl. ..... 418/55.5; 418/55.1; 418/55.4; 418/57

(58) Field of Classification Search ..... 418/55.1, 418/55.5, 55.2, 57
See application file for complete search history.

(56) References Cited

U.S. PATENT DOCUMENTS

| | | | | |
|---|---|---|---|---|
| 4,767,293 | A | 8/1988 | Caillat et al. | |
| 4,877,382 | A | 10/1989 | Caillat et al. | |
| 4,992,033 | A | 2/1991 | Caillat et al. | |
| 5,040,953 | A | 8/1991 | Tinsler | |
| 5,102,316 | A | 4/1992 | Caillat et al. | |
| 5,114,322 | A | 5/1992 | Caillat et al. | |
| 5,197,868 | A | 3/1993 | Caillat et al. | |
| 5,219,281 | A | 6/1993 | Caillat et al. | |
| 5,295,813 | A | 3/1994 | Caillat et al. | |
| 5,407,335 | A | 4/1995 | Caillat et al. | |
| 5,411,384 | A | 5/1995 | Bass et al. | |
| 5,427,511 | A | 6/1995 | Caillat et al. | |
| 5,482,450 | A | 1/1996 | Caillat et al. | |
| 5,580,230 | A | 12/1996 | Keifer et al. | |
| 5,745,992 | A | 5/1998 | Caillat et al. | |
| 5,772,416 | A | 6/1998 | Caillat et al. | |
| 5,897,306 | A * | 4/1999 | Beck | 418/55.3 |
| 5,931,649 | A | 8/1999 | Caillat et al. | |
| 6,345,966 | B1 * | 2/2002 | Hahn et al. | 418/55.1 |
| 6,589,022 | B2 * | 7/2003 | Yokomachi et al. | 417/222.2 |
| 6,679,683 | B2 * | 1/2004 | Seibel et al. | 417/213 |
| 2005/0201883 | A1 * | 9/2005 | Clendenin et al. | 418/55.5 |

* cited by examiner

*Primary Examiner*—Thomas Denion
*Assistant Examiner*—Mary A Davis
(74) *Attorney, Agent, or Firm*—Harness, Dickey & Pierce, P.L.C.

(57) ABSTRACT

A scroll machine includes a shell and a pair of scroll members. At least one of the scroll members disposed in the shell is mounted for axial movement with respect to the other scroll member disposed in the scroll. The amount of axial movement of at least one scroll member is accurately controlled by providing a stop. The stop is defined by the contact of the end plate of the at least one scroll member with another member of the scroll machine which is accurately positioned within the shell of the scroll machine. The member can be either the shell or another component which engages the shell.

4 Claims, 6 Drawing Sheets

FLANGED SLEEVE GUIDE

FIELD OF THE INVENTION

The present invention relates to mounting arrangements for the scroll member of a scroll machine. More particularly, the present invention relates to a flanged sleeve guide used for mounting one of the scroll members having axial compliance.

BACKGROUND AND SUMMARY OF THE INVENTION

A class of machines exists in the art generally known as "scroll" machines for the displacement of various types of fluids. Such machines may be configured as an expander, a displacement engine, a pump, a compressor, etc., and the features of the present invention are applicable to any one of these machines. For purposes of illustration, however, the disclosed embodiments are in the form of a hermetic refrigerant compressor.

Generally speaking, a scroll machine comprises two spiral scroll wraps of similar configuration, each mounted on a separate end plate to define a scroll member. The two scroll members are interfitted together with one of the scroll wraps being rotationally displaced 180° from the other. The machine operates by orbiting one scroll member (the "orbiting scroll") with respect to the other scroll member (the "fixed scroll" or "non-orbiting scroll") to make moving line contacts between the flanks of the respective wraps, to define moving isolated crescent-shaped pockets of fluid. The spiral wraps are commonly formed as involutes of a circle, and ideally there is no relative rotation between the scroll members during operation; i.e., the motion is purely curvilinear translation (i.e., no rotation of any line in the body). The fluid pockets carry the fluid to be handled from a first zone in the scroll machine where a fluid inlet is provided, to a second zone in the machine where a fluid outlet is provided. The volume of a sealed pocket changes as it moves from the first zone to the second zone. At any one instant in time there will be at least one pair of sealed pockets; and where there are several pairs of sealed pockets at one time, each pair will have different volumes. In a compressor, the second zone is at a higher pressure than the first zone and is physically located centrally in the machine, the first zone being located at the outer periphery of the machine.

Two types of contacts define the fluid pockets formed between the scroll members, axially extending tangential line contacts between the spiral faces or flanks of the wraps caused by radial forces ("flank sealing"), and area contacts caused by axial forces between the plane edge surfaces (the "tips") of each wrap and the opposite end plate ("tip sealing"). For high efficiency, good sealing must be achieved for both types of contacts; however, the present invention is primarily concerned with tip sealing.

The concept of a scroll-type machine has thus been known for some time and has been recognized as having distinct advantages. For example, scroll machines have high isentropic and volumetric efficiency, and, hence, are relatively small and lightweight for a given capacity. They are quieter and more vibration free than many machines because they do not use large reciprocating parts (e.g., pistons, connecting rods, etc.); and because all fluid flow is in one direction with simultaneous compression in plural opposed pockets, there are less pressure-created vibrations. Such machines also tend to have high reliability and durability because of the relatively few moving parts utilized and the relatively low velocity of movement between the scrolls. Scroll machines which have radial compliance to allow flank leakage have an inherent forgiveness to fluid contamination.

One of the difficult areas of design in a scroll-type machine concerns the technique used to achieve tip sealing under all operating conditions, and also during all speeds in a variable speed machine. Conventionally, this has been accomplished by (1) using extremely accurate and very expensive machining techniques, (2) providing the wrap tips with spiral tip seals, which, unfortunately, are hard to assemble and often unreliable, or (3) applying an axially restoring force by axial biasing the orbiting scroll or the non-orbiting scroll towards the opposing scroll using compressed working fluid. The latter technique has some advantages but also presents problems. Namely, in addition to providing a restoring force to balance the axial separating force, it is also necessary to balance the tipping moment on the scroll member due to pressure-generated radial forces which are dependent on suction and discharge pressures, as well as the inertial loads resulting from the orbital motion which is speed dependent. Thus, the axial balancing force must be relatively high, and will be optimal at only certain pressure and speed combinations.

The utilization of an axial restoring force requires one of the two scroll members to be mounted for axial movement with respect to the other scroll member. This can be accomplished by securing the non-orbiting scroll member to a main bearing housing by means of a plurality of bolts and a plurality of sleeve guides as disclosed in Assignee's U.S. Pat. No. 5,407,335, the disclosure of which is hereby incorporated herein by reference. In the mounting system which utilizes bolts and sleeve guides, arms formed on the non-orbiting scroll member are made to react against and slidingly engage the sleeve guides. The sleeve guides hold the scroll member in proper alignment. The non-orbiting scroll member experiences gas forces in the axial, radial and tangential direction whose centroid of application is at or near the mid-height of the scroll vane or wrap. The non-orbiting scroll member also experiences tip and base friction which can be randomly more on one than the other, but can be assumed as being equal and, therefore, having a centroid at or near the mid-height of the scroll wrap or vane. The non-orbiting scroll member additionally experiences flank contact forces from the centripetal acceleration of the orbiting scroll member which acts closer to the vane tip than at the base of the vane. All of these forces combine to yield a centroid of action which is located at a point just off the mid-height of the scroll wrap or vane toward the vane tip.

On scroll machines that incorporate axial compliance of one of the scroll members, it is necessary to provide a stop to limit the axial movement of the axial compliant scroll member.

When the orbiting scroll member is the axial compliant member, the orbiting scroll member will be biased against the non-orbiting scroll member during compressor operation and the orbiting scroll member will be limited in its axial movement away from the non-orbiting scroll member by a main bearing housing or by a fixed component of the scroll machine.

When the non-orbiting scroll member is the axial compliant member, the non-orbiting scroll member is typically mounted for axial movement on a set of sleeve guides. The non-orbiting scroll member is biased against the orbiting scroll member during compressor operation and the non-orbiting scroll member will move axially away from the orbiting scroll member by sliding along the sleeve guides. Typically, the sleeve guides are mounted to a main bearing housing or a fixed component of the scroll machine by a bolt with the head of the bolt acting as a stop to limit the axial movement of the non-orbiting scroll.

While utilizing the bolt head as a stop has performed satisfactory in most of the prior art designs of scroll machines. Newer scroll machines are being designed which require tighter control over the amount of axial travel provided. The combination of using a bolt with a sleeve guide and all of the tolerance stack-ups associated with this design do not permit the tighter control over the amount of axial travel without adding additional costs for the manufacture of the scroll machine.

The present invention provides the art with a sleeve guide which is designed to work in conjunction with another component of the scroll machine to accurately control the axial movement of the non-orbiting scroll member. The sleeve guide preferably works in conjunction with the partition to accurately control the amount of axial movement as well as provide a positive stop for the non-orbiting scroll member since the partition is secured to the shell of the compressor.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
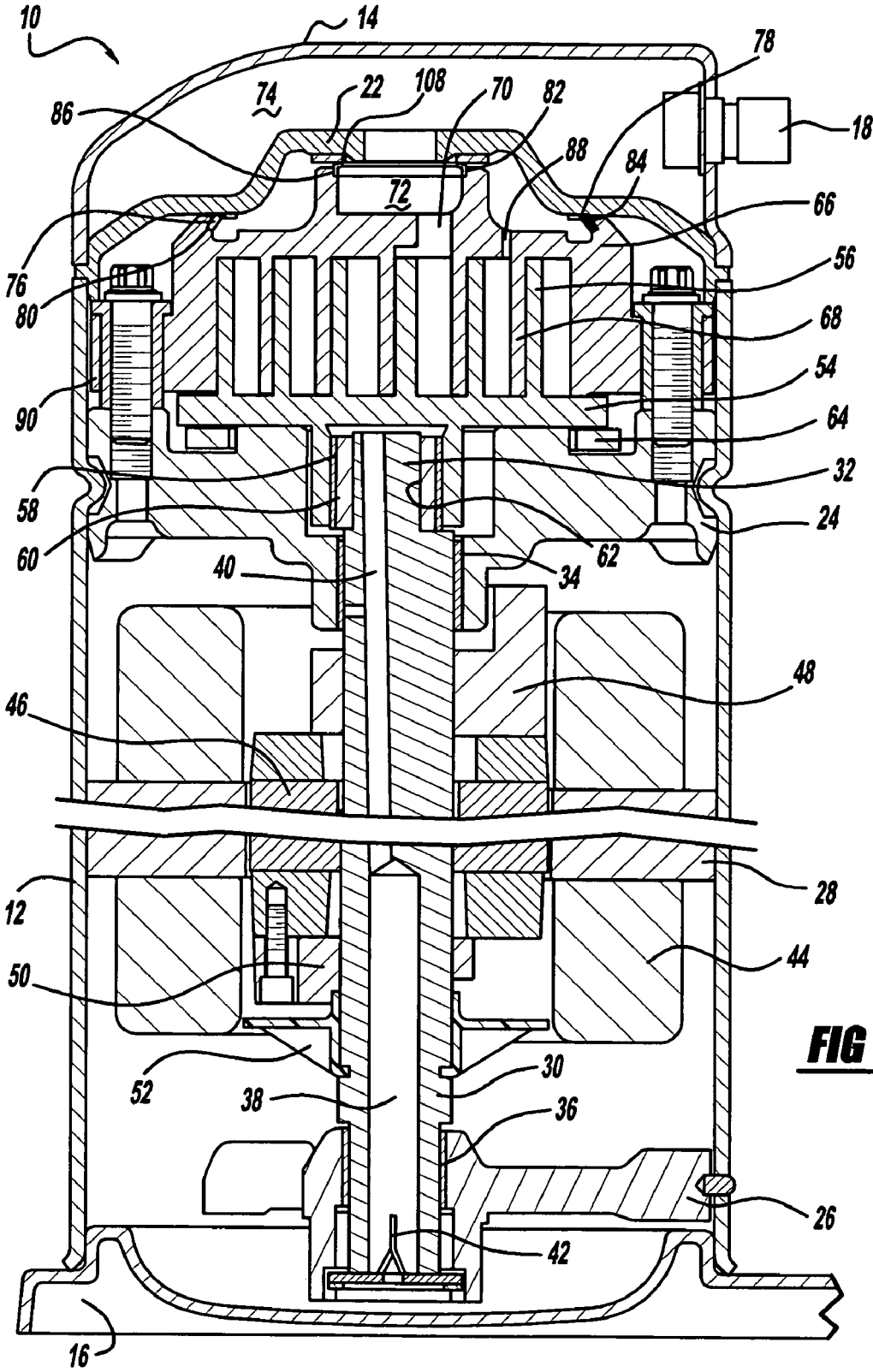
FIG. 1 is a vertical cross-sectional view of a scroll compressor incorporating a non-orbiting scroll mounting arrangement in accordance with the present invention.

There is illustrated in FIG. 1 a scroll compressor which incorporates a non-orbiting scroll mounting arrangement in accordance with the present invention and which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a stationary main bearing housing or body 24 which is suitably secured to shell 12, and a lower bearing housing 26 also having a plurality of radially outwardly extending legs, each of which is also suitably secured to shell 12. A motor stator 28, which is generally square in cross-section but with the corners rounded off, is pressfitted into shell 12. The flats between the rounded corners on the stator provide passageways between the stator and shell, which facilitate the flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of the crankshaft. Disposed within bore 38 is a stirrer 42. The lower portion of the interior shell 12 is filled with lubricating oil, and bore 38 acts as a pump to pump lubricating fluid up the crankshaft 30 and into bore 40, and ultimately to all of the various portions of the compressor which require lubrication.

Crankshaft 30 is rotatively driven by an electric motor including stator 28, windings 44 passing therethrough and a rotor 46 pressfitted on the crankshaft 30 and having upper and lower counterweights 48 and 50, respectively. A counterweight shield 52 may be provided to reduce the work loss caused by counterweight 50 spinning in the oil in the sump. Counterweight shield 52 is more fully disclosed in Assignee's U.S. Pat. No. 5,064,356 entitled "Counterweight Shield For Scroll Compressor," the disclosure of which is hereby incorporated herein by reference.

The upper surface of main bearing housing 24 is provided with a flat thrust bearing surface on which is disposed an orbiting scroll member 54 having the usual spiral vane or wrap 56 on the upper surface thereof. Projecting downwardly from the lower surface of orbiting scroll member 54 is a cylindrical hub having a journal bearing 58 therein and in which is rotatively disposed a drive bushing 60 having an inner bore 62 in which crank pin 32 is drivingly disposed. Crank pin 32 has a flat on one surface which drivingly engages a flat surface (not shown) formed in a portion of bore 62 to provide a radially compliant driving arrangement, such as shown in aforementioned Assignee's U.S. Pat. No. 4,877,382, the disclosure of which is hereby incorporated herein by reference. An Oldham coupling 64 is also provided positioned between and keyed to orbiting scroll member 54 and main bearing housing 24 to prevent rotational movement of orbiting scroll member 54. Oldham coupling 64 is preferably of the type disclosed in the above-referenced U.S. Pat. No. 4,877,382; however, the coupling disclosed in Assignee's U.S. Pat. No. 5,320,506 entitled "Oldham Coupling For Scroll Compressor", the disclosure of which is hereby incorporated herein by reference, may be used in place thereof.

A non-orbiting scroll member 66 is also provided having a wrap 68 extending from an end plate. Wrap 68 is positioned in meshing engagement with wrap 56 of orbiting scroll member 54. Non-orbiting scroll member 66 has a centrally disposed discharge passage 70 communicating with an upwardly open recess 72 which is in fluid communication with a discharge muffler chamber 74 defined by cap 14 and partition 22. An annular recess 76 is also formed in non-orbiting scroll member 66 to define an axial pressure biasing chamber which receives pressurized fluid being compressed by wraps 56 and 68 so as to exert an axial biasing force on non-orbiting scroll member 66 to thereby urge the tips of respective wraps 56, 68 into sealing engagement with the opposed end plate surfaces.

A sealing system 78 seals fluid pressure within annular recess 76 by sealingly engaging partition 22 and non-orbiting scroll member 66. Sealing system 78 comprises an outer seal groove 80 formed in non-orbiting scroll member 66, an inner seal groove 82 formed in non-orbiting scroll member 66, an outer seal 84 disposed within outer seal groove 80 and an inner seal 86 disposed within inner seal groove 82. Annular recess 76 is located between outer seal groove 80 and inner seal groove 82. Annular recess 76 is provided with compressed fluid through a fluid passage 88 which opens to a fluid pocket defined by non-orbiting scroll wrap 68 of non-orbiting scroll member 66 and orbiting scroll wrap 56 of orbiting scroll member 54. The pressurized fluid provided through fluid passage 88 is at a pressure which is intermediate or in between the suction pressure and the discharge pressure of compressor 10. The fluid pressure within annular recess 76 biases non-orbiting scroll member 66 towards orbiting scroll member 54 to enhance the tip sealing characteristics between the two scroll members.

Outer seal 84 sealingly engages non-orbiting scroll member 66 and partition 22 to isolate annular recess 76 from suction pressure. Inner seal 86 engages non-orbiting scroll member 66 and partition 22 to isolate annular recess 76 from discharge pressure.

Figure 2:
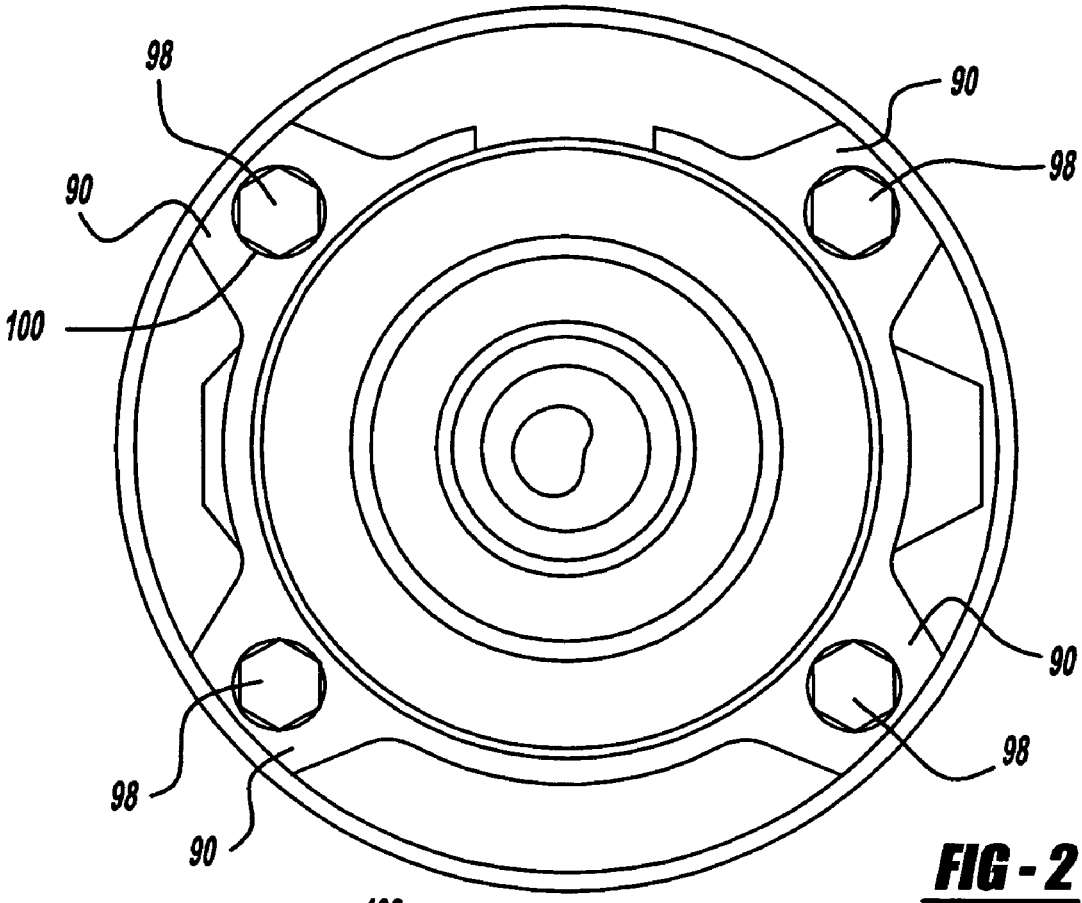
FIG. 2 is a top view of the compressor of FIG. 1, with the cap, the partition and the floating seal removed.

Non-orbiting scroll member 66 is designed to be mounted to main bearing housing 24 in such a manner that non-orbiting scroll member 66 is not allowed to rotate with respect to main bearing housing 24, but non-orbiting scroll member 66 is permitted to move axially with respect to main bearing housing 24. The end plate of non-orbiting scroll member 66 has a plurality of radially outwardly projecting flange portions 90 circumferentially spaced around the periphery thereof as shown in FIG. 2.

Figure 3:
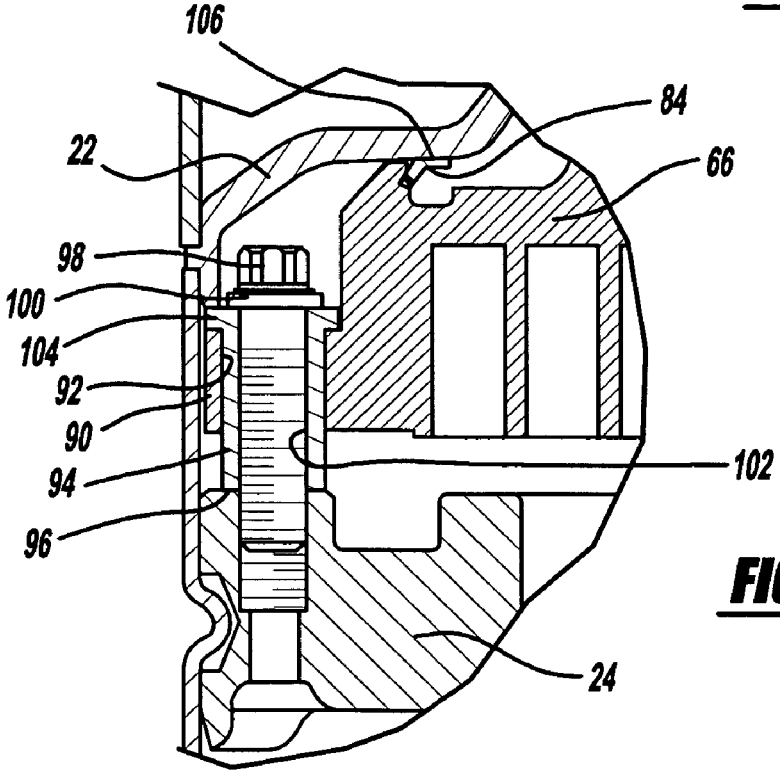
FIG. 3 is an enlarged fragmentary section view of the mounting arrangement shown in FIG. 1; and, FIGS. 4-11 are views similar to FIG. 3, but showing mounting arrangements in accordance with other embodiments of the present invention.

As best seen with reference to FIG. 3, flange portion 90 of non-orbiting scroll member 66 has an opening 92 provided therein within which is fitted an elongated cylindrical flanged sleeve guide 94, the lower end 96 of which is seated on main bearing housing 24. A bolt 98 having a head washer 100 extends through an axially extending bore 102 provided in sleeve guide 94 and into a threaded opening provided in main bearing housing 24. As shown, bore 102 of sleeve guide 94 is of a diameter greater than the diameter of bolt 98 so as to accommodate some relative movement therebetween to enable final precise positioning of non-orbiting scroll member 66. Once non-orbiting scroll member 66 and, hence, sleeve guide 94 have been precisely positioned, bolt 98 may be suitably torqued thereby securely and fixedly clamping sleeve guide 94 between main bearing housing 24 and washer 100. Washer 100 serves to ensure uniform circumferential loading on sleeve guide 94 as well as to provide a bearing surface for the head of bolt 98 thereby avoiding any potential shifting of sleeve guide 94 during the final torquing of bolt 98. It should be noted that as shown in FIG. 3, the axial length of sleeve guide 94 will be sufficient to allow non-orbiting scroll member 66 to slidably move axially along sleeve guide 94 in a direction away from orbiting scroll member 54, thereby affording an axially compliant mounting arrangement. Substantially identical sleeve guides 94, bolts 98 and washers 100 are provided for each of the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 98 and the associated sleeve guides 94, the threaded openings in main bearing housing 24 need not be as precisely located as would otherwise be required, thus reducing the manufacturing costs associated therewith.

Sleeve guides 94 include a large diameter portion or flange 104 which acts as a stop for the upward axial movement of flange portion 90 of non-orbiting scroll member 66. Partition 22 abuts the top surface of flange 104 of sleeve guide 94 so that the position of a seal interface 106 for outer seal 84 and a seal interface 108 (FIG. 1) for inner seal 86 are accurately located. Outer seal 84 and inner seal 86 are annular L-shape seals which require tight controls on the amount of axial movement for flange portion 90 of non-orbiting scroll member. 66. By having flange 104 act as an upper stop for non-orbiting scroll member 66 and then locating the position of partition 22 and thus seal surfaces 106 and 108 by having partition 22 abut flange 104, the amount of axial movement of non-orbiting scroll member 66 can be controlled to the amount necessary for the proper functioning of outer seal 84 and inner seal 86.

Figure 4:
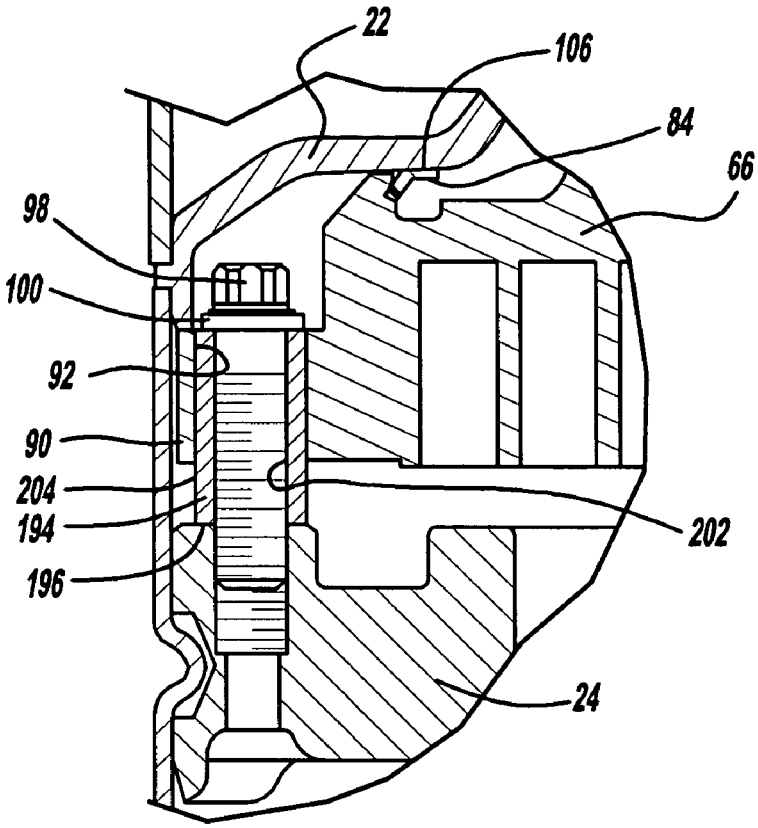

Referring now to FIG. 4, a scroll mounting system in accordance with another embodiment of the present invention. An elongated cylindrical sleeve guide 194 is fitted within opening 92 of flange portion 90 of non-orbiting scroll member 66. The lower end 196 of sleeve guide 194 is seated on main bearing housing 24. Bolt 98 having head washer 100 extends through an axially extending bore 202 provided in sleeve guide 194 and into a threaded opening provided in main bearing housing 24. As shown, bore 202 of sleeve guide 194 is of a diameter greater than the diameter of bolt 98 so as to accommodate some relative movement there between to enable final precise positioning of non-orbiting scroll member 66. Once non-orbiting scroll member 66 and, hence, sleeve guide 194 have been precisely positioned, bolt 98 may be suitably torqued thereby securely and fixedly clamping sleeve guide 194 between main bearing housing 24 and washer 100. Washer 100 serves to ensure uniformly circumferential loading on sleeve guide 194 as well as to provide a bearing surface for the head of bolt 98 thereby avoiding any potential shifting of sleeve guide 194 during the final torquing of bolt 98. It should be noted that as shown in FIG. 4, the axial length of sleeve guide 194 will be sufficient to allow non-orbiting scroll member 66 to slidably move axially along sleeve guide 194 in a direction away from orbiting scroll member 54, thereby affording an axially compliant mounting arrangement. Substantially identical sleeve guides 194, bolts 98 and washers 100 are provided for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 98 and the associated sleeve guides 194, the threaded openings in main bearing housing 24 need not be as precisely located as would otherwise be required, thus reducing the manufacturing costs associated therewith.

Sleeve guide 194 includes a stepless outer cylindrical surface 204 which accommodates the axial movement of non-orbiting scroll member 66. Partition 22 abuts the top surface of sleeve guide 194 so that the position of seal interface 106 for outer seal 84 and seal surface 108 (FIG. 1) for inner seal 86 are accurately located. Outer seal 84 and inner seal 86 are annular L-shaped seals which require tight controls on the amount of axial movement for non-orbiting scroll member 66. In this embodiment, the lower edge surface of partition 22 acts as a stop for the upward axial movement of flange portion 90 of non-orbiting scroll member 66. By having the lower edge surface of partition 22 act as an upper stop for flange portion 90 of non-orbiting scroll member 66, the amount of axial movement of non-orbiting scroll member 66 can be controlled to the amount necessary for the proper functioning of outer seal 84 and inner seal 86. While the lower edge surface of partition 22 is being illustrated as the upper stop for non-orbiting scroll member 66, it is within the scope of the present invention to utilize seal interface 106 or seal interface 108 for the upper stop for non-orbiting scroll member 66 if desired.

Figure 5:
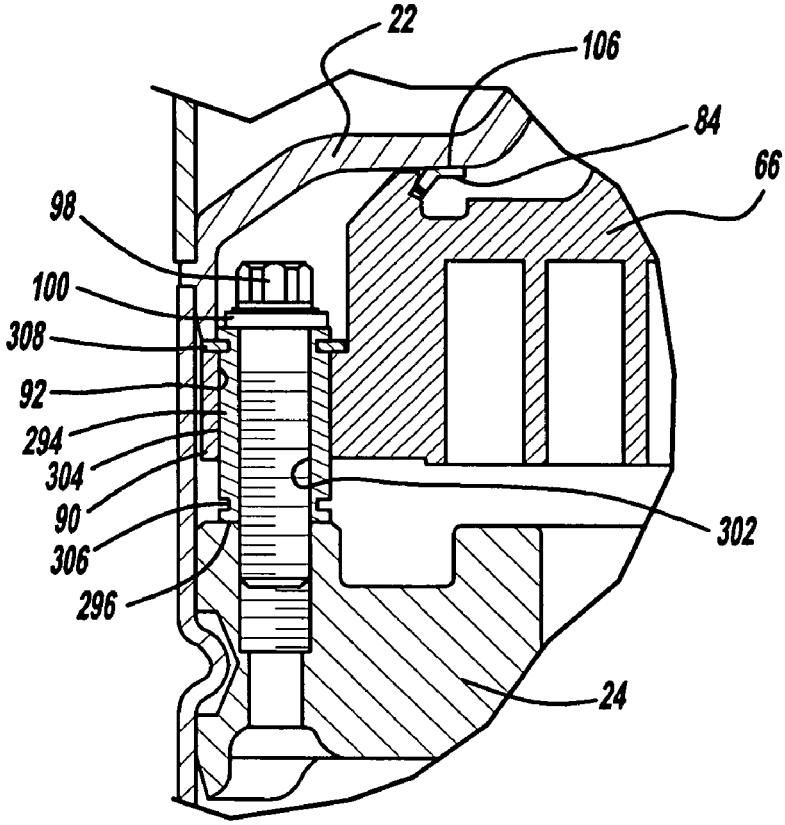

Referring now to FIG. 5, a scroll mounting system in accordance with another embodiment of the present invention. An elongated cylindrical sleeve guide 294 is fitted within opening 92 of flange portion 90 of non-orbiting scroll member 66. The lower end 296 of sleeve guide 294 is seated on main bearing housing 24. Bolt 98 having head washer 100 extends through an axially extending bore 302 provided in sleeve guide 294 and into a threaded opening provided in main bearing housing 24. As shown, bore 302 of sleeve guide 294 is of a diameter greater than the diameter of bolt 98 so as to accommodate some relative movement therebetween to enable final precise positioning of non-orbiting scroll member 66. Once non-orbiting scroll member 66 and, hence, sleeve guide 294 have been precisely positioned, bolt 98 may be suitably torqued thereby securely and fixedly clamping sleeve guide 294 between main bearing housing 24 and washer 100. Washer 100 serves to ensure uniform circumferential loading on sleeve guide 294 as well as to provide a bearing surface for the head of bolt 98 thereby avoiding any potential shifting of sleeve guide 294 during the final torquing of bolt 98. It should be noted that as shown in FIG. 5, the axial length of sleeve guide 294 will be sufficient to allow non-orbiting scroll member 66 to slidably move axially along sleeve guide 294 in a direction away from orbiting scroll member 54, thereby affording an axially compliant mounting arrangement. Substantially identical sleeve guides 294, bolts 98 and washers 100 are provided for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 98 and the associated sleeve guides 294, the threaded openings in main bearing housing 24 need not be as precisely located as would otherwise be required, thus reducing the manufacturing costs associated therewith.

Sleeve guide 294 includes an outer cylindrical surface 304 which defines a pair of snap-ring grooves 306. Snap-ring grooves 306 are each located in the same position relative to their respective end of sleeve guide 294 such that sleeve guide 294 is symmetrical and therefore does not require orientation during assembly. A snap ring 308 is located within the upper snap-ring groove 306 to act as a stop for the upward movement of flange portion 90 of non-orbiting scroll member 66. Partition 22 abuts the top surface of snap-ring 308 of sleeve guide 294 so that the position of seal interface 106 for outer seal 84 and seal interface 108 (FIG. 1) for inner seal 86 are accurately located. Outer seal 84 and inner seal 86 are annular L-shape seals which require tight controls on the amount of axial movement for non-orbiting scroll member 66. By having snap-ring 308 act as an upper stop for flange portion 90 of non-orbiting scroll member 66 and then locating the position of partition 22 and thus seal surfaces 106 and 108 by having partition 22 abut snap-ring 308, the amount of axial movement of non-orbiting scroll member 66 can be controlled to the amount necessary for the proper functioning of outer seal 84 and inner seal 86. Similar to the embodiment illustrated in FIG. 4, seal interface 106 or seal interface 108 can be utilized for the upper stop for non-orbiting scroll member 66 in this embodiment.

Figure 6:
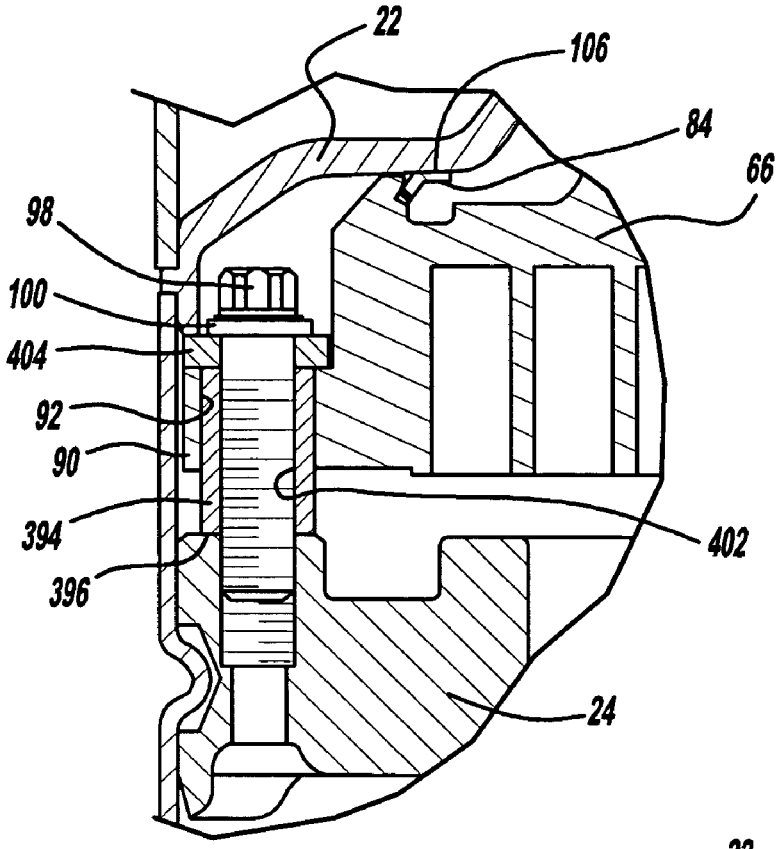

Referring now to FIG. 6, a scroll mounting system in accordance with another embodiment of the present invention. An elongated cylindrical sleeve guide 394 is fitted within opening 92 of flange portion 90 of non-orbiting scroll member 66. The lower end 396 of sleeve guide 394 is seated on main bearing housing 24. Bolt 98 having head washer 100 extends through an axially extending bore 402 provided in sleeve guide 394 and into a threaded opening provided in main bearing housing 24. As shown, bore 402 of sleeve guide 394 is of a diameter greater than the diameter of bolt 98 so as to accommodate some relative movement therebetween to enable final precise positioning of non-orbiting scroll member 66. A spacer 404 is positioned between washer 100 of bolt 98 and sleeve guide 394. Once non-orbiting scroll member 66 and, hence, sleeve guide 394 and spacer 404 have been precisely positioned, bolt 98 may be suitably torqued thereby securely and fixedly clamping sleeve guide 394 between main bearing housing 24 and spacer 404. Spacer 404 serves to ensure uniform circumferential loading on sleeve guide 394 as well as to provide a bearing surface for the head of bolt 98 thereby avoiding any potential shifting of sleeve guide 394 during the final torquing of bolt 98. It should be noted that as shown in FIG. 6, the axial length of sleeve guide 394 will be sufficient to allow non-orbiting scroll member 66 to slidably move axially along sleeve guide 394 in a direction away from orbiting scroll member 54, thereby affording an axially compliant mounting arrangement. Substantially identical sleeve guides 394, bolts 98 and washers 100 are provided for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 98 and the associated sleeve guides 394, the threaded openings in main bearing housing 24 need not be as precisely located as would otherwise be required, thus reducing the manufacturing costs associated therewith.

Spacer 404 is disposed between sleeve guide 394 and washer 100 of bolt 98 to act as a stop for the upward axial movement of flange portion 90 of non-orbiting scroll member 66. Partition 22 abuts the top surface of spacer 404 of sleeve guide 394 so that the position of seal interface 106 for outer seal 84 and seal interface 108 (FIG. 1) for inner seal 86 are accurately located. Outer seal 84 and inner seal 86 are annular L-shape seals which require tight controls on the amount of axial movement for non-orbiting scroll member 66. By having spacer 404 act as an upper stop for flange portion 90 of non-orbiting scroll member 66 and then locating the position of partition 22 and thus seal surfaces 106 and 108 by having partition 22 abut spacer 404, the amount of axial movement of non-orbiting scroll member 66 can be controlled to the amount necessary for the proper functioning of outer seal 84 and inner seal 86. Similar to the embodiment illustrated in FIG. 4, seal interface 106 or seal interface 108 can be utilized for the upper stop for non-orbiting scroll member 66 in this embodiment.

Figure 7:
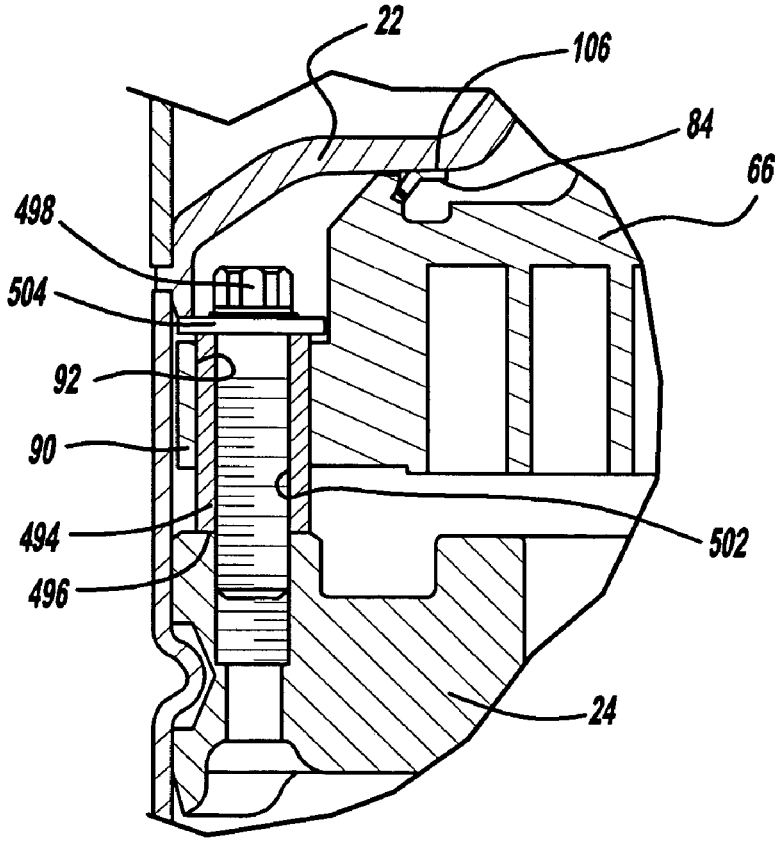

Referring now to FIG. 7, a scroll mounting system in accordance with another embodiment of the present invention. An elongated cylindrical sleeve guide 494 is fitted within opening 92 of flange portion 90 of non-orbiting scroll member 66. The lower end 496 of sleeve guide 494 is seated on main bearing housing 24. A bolt 498 having a flange 504 extends through an axially extending bore 502 provided in sleeve guide 494 and into a threaded opening provided in main bearing housing 24. As shown, bore 502 of sleeve guide 494 is of a diameter greater than the diameter of bolt 498 so as to accommodate some relative movement therebetween to enable final precise positioning of non-orbiting scroll member 66. Once non-orbiting scroll member 66 and, hence, sleeve guide 494 have been precisely positioned, bolt 498 may be suitably torqued thereby securely and fixedly clamping sleeve guide 494 between main bearing housing 24 and flange 504. Flange 504 serves to ensure uniform circumferential loading on sleeve guide 494 thereby avoiding any potential shifting of sleeve guide 494 during the final torquing of bolt 498. It should be noted that as shown in FIG. 7, the axial length of sleeve guide 494 will be sufficient to allow non-orbiting scroll member 66 to slidably move axially along sleeve guide 494 in a direction away from orbiting scroll member 54, thereby affording an axially compliant mounting arrangement. Substantially identical sleeve guides 494, bolts 498 and flanges 504 are provided for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 498 and the associated sleeve guides 494, the threaded openings in main bearing housing 24 need not be as precisely located as would otherwise be required, thus reducing the manufacturing costs associated therewith.

Flanges 504 of bolts 498 act as a stop for the upward axial movement of flange portion 90 of non-orbiting scroll member 66. Partition 22 abuts the top surface of flange 504 of bolt 498 so that the position of seal interface 106 for outer seal 84 and seal interface 108 (FIG. 1) for inner seal 86 are accurately located. Outer seal 84 and inner seal 86 are annular L-shape seals which require tight controls on the amount of axial movement for non-orbiting scroll member 66. By having flange 504 act as an upper stop for non-orbiting scroll member 66 and then locating the position of partition 22 and thus seal surfaces 106 and 108 by having partition 22 abut flange 504, the amount of axial movement of non-orbiting scroll member 66 can be controlled to the amount necessary for the proper functioning of outer seal 84 and inner seal 86. Similar to the embodiment illustrated in FIG. 4, seal interface 106 or seal interface 108 can be utilized for the upper stop for non-orbiting scroll member 66 in this embodiment.

Figure 8:
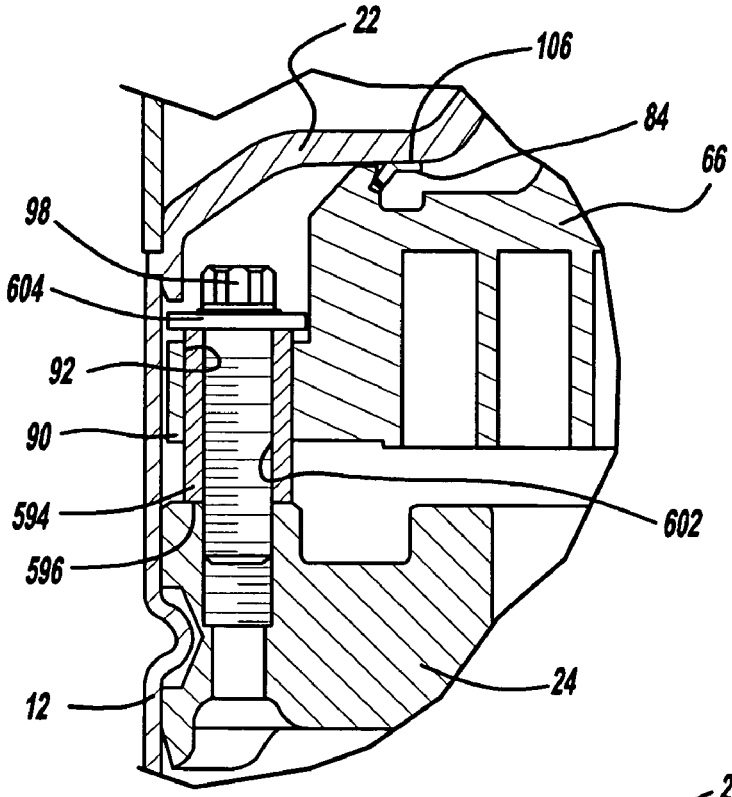

Referring now to FIG. 8, a scroll mounting system in accordance with another embodiment of the present invention. An elongated cylindrical sleeve guide 594 is fitted within opening 92 of flange portion 90 of non-orbiting scroll member 66. The lower end 596 of sleeve guide 594 is seated on main bearing housing 24. Bolt 98 extends through an axially extending bore 602 provided in sleeve guide 594 and into a threaded opening provided in main bearing housing 24. As shown, bore 602 of sleeve guide 594 is of a diameter greater than the diameter of bolt 98 so as to accommodate some relative movement therebetween to enable final precise positioning of non-orbiting scroll member 66. A spacer 604 is disposed between bolt 98 and sleeve guide 594. Once non-orbiting scroll member 66 and, hence, sleeve guide 594 and spacer 604 have been precisely positioned, bolt 98 may be suitably torqued thereby securely and fixedly clamping sleeve guide 594 between main bearing housing 24 and spacer 604. Spacer 604 serves to ensure uniform circumferential loading on sleeve guide 594 as well as to provide a bearing surface for the head of bolt 98 thereby avoiding any potential shifting of sleeve guide 594 during the final torquing of bolt 98. It should be noted that as shown in FIG. 8, the axial length of sleeve guide 594 will be sufficient to allow non-orbiting scroll member 66 to slidably move axially along sleeve guide 594 in a direction away from orbiting scroll member 54, thereby affording an axially compliant mounting arrangement. Substantially identical sleeve guides 594, bolts 98 and spacers 604 are provided for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 98 and the associated sleeve guides 594, the threaded openings in main bearing housing 24 need not be as precisely located as would otherwise be required, thus reducing the manufacturing costs associated therewith.

In this design, the dimension between the top of main bearing housing 24 and the top edge of shell 12 are tightly controlled during the machining operation. Partition 22 abuts the top edge of shell 12 so that the position of seal interface 106 for outer seal 84 and seal interface 108 (FIG. 1) for inner seal 86 are accurately located in relation to the top of main bearing housing 24. In this embodiment, either seal interface 106 or seal interface 108 acts as a stop for the upward movement of non-orbiting scroll member 66. Outer seal 84 and inner seal 86 are annular L-shape seals which require tight controls on the amount of axial movement for non-orbiting scroll member 66. By having seal interface 106 or seal interface 108 act as an upper stop for non-orbiting scroll member 66 and then locating the position of partition 22 and thus seal surfaces 106 and 108 by having partition 22 abut the top edge of shell 12 while controlling the dimension between the top edge of shell 12 and the top surface of main bearing housing 24, the amount of axial movement of non-orbiting scroll member 66 can be controlled to the amount necessary for the proper functioning of outer seal 84 and inner seal 86.

Figure 9:
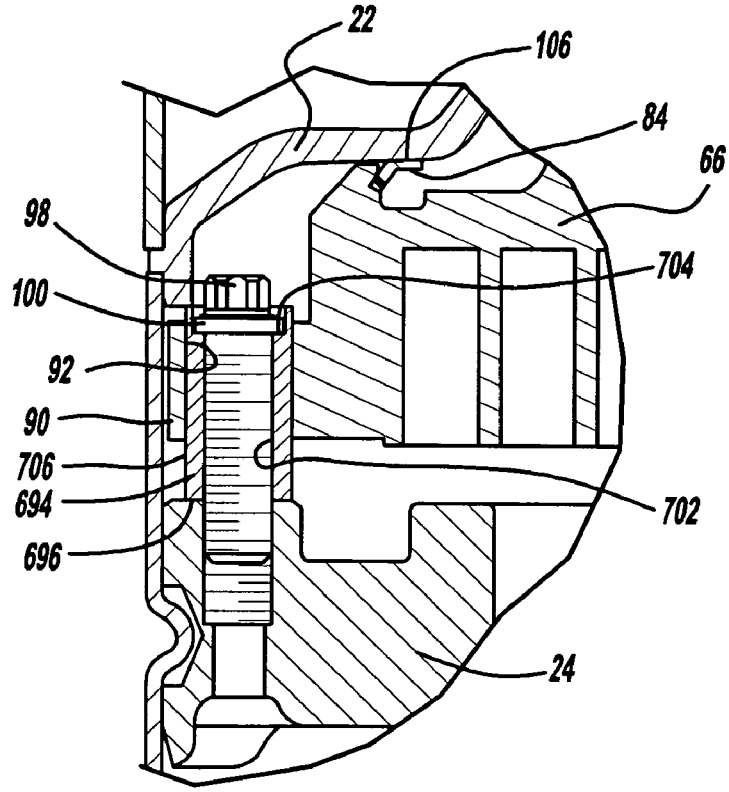

Referring now to FIG. 9, a scroll mounting system in accordance with another embodiment of the present invention. An elongated cylindrical sleeve guide 694 is fitted within opening 92 of flange portion 90 of non-orbiting scroll member 66. The lower end 696 of sleeve guide 694 is seated on main bearing housing 24. Bolt 98 having head washer 100 extends through an axially extending bore 702 provided in sleeve guide 694 and into a threaded opening provided in main bearing housing 24. As shown, bore 702 of sleeve guide 694 is of a diameter greater than the diameter of bolt 98 so as to accommodate some relative movement therebetween to enable final precise positioning of non-orbiting scroll member 66. Once non-orbiting scroll member 66 and, hence, sleeve guide 694 have been precisely positioned, bolt 98 may be suitably torqued thereby securely and fixedly clamping sleeve guide 694 between main bearing housing 24 and washer 100. Sleeve guide 694 defines a recess 704 within which washer 100 of bolt 98 is positioned. Washer 100 serves to ensure uniform circumferential loading on sleeve guide 694 as well as to provide a bearing surface for the head of bolt 98 thereby avoiding any potential shifting of sleeve guide 94 during the final torquing of bolt 98. It should be noted that as shown in FIG. 9, the axial length of sleeve guide 694 will be sufficient to allow non-orbiting scroll member 66 to slidably move axially along sleeve guide 694 in a direction away from orbiting scroll member 54, thereby affording an axially compliant mounting arrangement. Substantially identical sleeve guides 694, bolts 98 and washers 100 are provided for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 98 and the associated sleeve guides 694, the threaded openings in main bearing housing 24 need not be as precisely located as would otherwise be required, thus reducing the manufacturing costs associated therewith.

Sleeve guide 694 includes a stepless outer cylindrical surface 706 which accommodates the axial movement of non-orbiting scroll member 66. Partition 22 abuts the top surface of sleeve guide 694 and it acts as a stop for the upward axial movement of non-orbiting scroll member 66. Partition 22 abuts the top surface of recess 704 of sleeve guide 694 so that the position of seal interface 106 for outer seal 84 and seal interface 108 (FIG. 1) for inner seal 86 are accurately located. Outer seal 84 and inner seal 86 are annular L-shape seals which require tight controls on the amount of axial movement for non-orbiting scroll member 66. By having partition 22 act as an upper stop for non-orbiting scroll member 66 and then locating the position of partition 22 and thus seal surfaces 106 and 108 by having partition 22 abut sleeve guide 694, the amount of axial movement of non-orbiting scroll member 66 can be controlled to the amount necessary for the proper functioning of outer seal 84 and inner seal 86.

Figure 10:
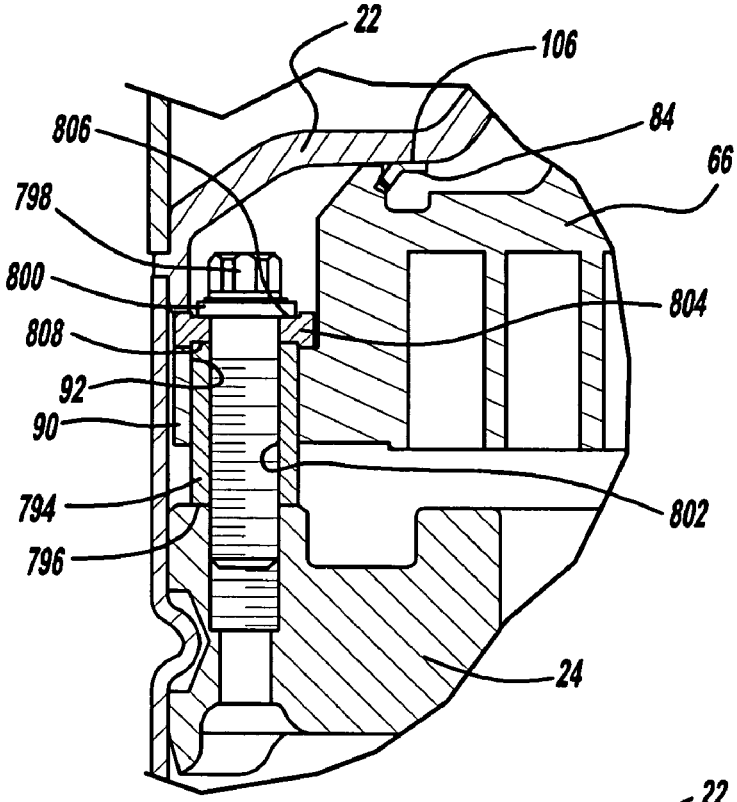

Referring now to FIG. 10, a scroll mounting system in accordance with another embodiment of the present invention. An elongated cylindrical sleeve guide 794 is fitted within opening 92 of flange portion 90 of non-orbiting scroll member 66. The lower end 796 of sleeve guide 794 is seated on main bearing housing 24. A bolt 798 having a head washer 800 extends through an axially extending bore 802 provided in sleeve guide 794 and into a threaded opening provided in main bearing housing 24. As shown, bore 802 of sleeve guide 794 is of a diameter greater than the diameter of bolt 798 so as to accommodate some relative movement therebetween to enable final precise positioning of non-orbiting scroll member 66. A spacer 804 is disposed between washer 800 of bolt 798 and sleeve guide 794. Spacer 804 defines an upper recess 806 within which spacer 800 is located and a lower recess 808 within which sleeve guide 794 is located. Recess 806 and 808 provide added stability to the assembly. Once non-orbiting scroll member 66 and, hence, sleeve guide 794 and spacer 804 have been precisely positioned, bolt 798 may be suitably torqued thereby securely and fixedly clamping sleeve guide 794 between main bearing housing 24 and spacer 804. Spacer 804 serves to ensure uniform circumferential loading on sleeve guide 794 as well as to provide a bearing surface for the head of bolt 798 thereby avoiding any potential shifting of sleeve guide 794 during the final torquing of bolt 798. It should be noted that as shown in FIG. 10, the axial length of sleeve guide 794 will be sufficient to allow non-orbiting scroll member 66 to slidably move axially along sleeve guide 794 in a direction away from orbiting scroll member 54, thereby affording an axially compliant mounting arrangement. Substantially identical sleeve guides 794, bolts 798, spacers 804 and washers 800 are provided for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 798 and the associated sleeve guides 794, the threaded openings in main bearing housing 24 need not be as precisely located as would otherwise be required, thus reducing the manufacturing costs associated therewith.

Spacer 804 acts as a stop for the upward axial movement of flange portion 90 of non-orbiting scroll member 66. Partition 22 abuts the top surface of spacer 804 of sleeve guide 794 so that the position of seal interface 106 for outer seal 84 and seal interface 108 (FIG. 1) for inner seal 86 are accurately located. Outer seal 84 and inner seal 86 are annular L-shape seals which require tight controls on the amount of axial movement for non-orbiting scroll member 66. By having spacer 804 act as an upper stop for flange portion 90 of non-orbiting scroll member 66 and then locating the position of partition 22 and thus seal interfaces 106 and 108 by having partition 22 abut spacer 804, the amount of axial movement of non-orbiting scroll member 66 can be controlled to the amount necessary for the proper functioning of outer seal 84 and inner seal 86.

Figure 11:
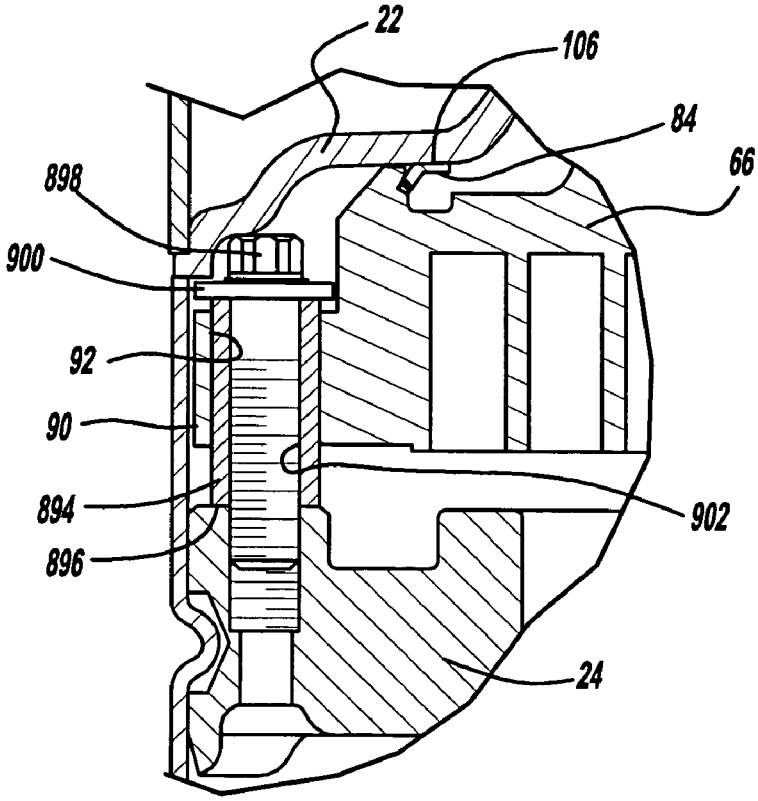

Referring now to FIG. 11, a scroll mounting system in accordance with another embodiment of the present invention. An elongated cylindrical sleeve guide 894 is fitted within opening 92 of flange portion 90 of non-orbiting scroll member 66. The lower end 896 of sleeve guide 894 is seated on main bearing housing 24. A bolt 898 having head washer 900 extends through an axially extending bore 902 provided in sleeve guide 894 and into a threaded opening provided in main bearing housing 24. As shown, bore 902 of sleeve guide 894 is of a diameter greater than the diameter of bolt 898 so as to accommodate some relative movement therebetween to enable final precise positioning of non-orbiting scroll member 66. Once non-orbiting scroll member 66 and, hence, sleeve guide 894 have been precisely positioned, bolt 898 may be suitably torqued thereby securely and fixedly clamping sleeve guide 894 between main bearing housing 24 and washer 900. Washer 900 serves to ensure uniform circumferential loading on sleeve guide 894 as well as to provide a bearing surface for the head of bolt 898 thereby avoiding any potential shifting of sleeve guide 94 during the final torquing of bolt 98. It should be noted that as shown in FIG. 4, the axial length of sleeve guide 894 will be sufficient to allow non-orbiting scroll member 66 to slidably move axially along sleeve guide 894 in a direction away from orbiting scroll member 54, thereby affording an axially compliant mounting arrangement. Substantially identical sleeve guides 894, bolts 898 and washers 900 are providing for the other flange portions 90. The amount of separating movement can be relatively small (e.g., on the order of 0.005" for a scroll 3" to 4" in diameter and 1" to 2" in wrap height) and, hence, the compressor will still operate to compress fluid even though the separating force resulting therefrom may exceed the axial restoring force such as may occur on start-up. Because the final radial and circumferential positioning of non-orbiting scroll member 66 is accommodated by the clearances provided between bolts 898 and the associated sleeve guides 894, the threaded openings in main bearing housing 24 need not be as precisely located as would otherwise be required, thus reducing the manufacturing costs associated therewith.

Seal interface 106 or seal interface 108 act as a stop for the upward axial movement of non-orbiting scroll member 66. Partition 22 abuts the top of the head of bolt 898 so that the position of seal interface 106 for outer seal 84 and seal interface 108 (FIG. 1) for inner seal 86 are accurately located. Outer seal 84 and inner seal 86 are annular L-shaped seals which require tight controls on the amount of axial movement for non-orbiting scroll member 66. By having seal interface 106 or seal interface 108 act as an upper stop for non-orbiting scroll member 66 and then locating the position of partition and thus the seal interfaces 106 and 108 by having partition 22 abut bolt 898, the amount of axial movement of non-orbiting scroll member 66 can be controlled to the amount necessary for the proper functioning of outer seal 84 and inner seal 86.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scroll machine comprising:

a shell defining a seal interface;

a first scroll member disposed within said shell, said first scroll member having a first spiral wrap extending from a first end plate;

a second scroll member disposed within said shell, said second scroll member having a second spiral wrap extending from a second end plate, said second scroll wrap being intermeshed with said first scroll wrap;

an axially compliant mounting structure securing said first scroll member to said shell, said axially compliant mounting structure allowing axial movement of said first scroll member with respect to said second scroll member; and an axial stop disposed on a component of said scroll machine shell for limiting the axial movement of said first scroll member in a direction away from said second scroll member by contacting a radially outwardly extending scroll flange on said first scroll member.

2. The scroll machine according to claim 1, wherein said shell comprises a partition dividing said shell into a suction pressure zone and a discharge pressure zone, said axial stop being disposed on said partition.

3. The scroll machine according to claim 1, further comprising a sleeve guide disposed in an opening defined by said scroll flange.

4. A scroll machine comprising:

a shell defining a seal interface;

a first scroll member disposed within said shell, said first scroll member having a first spiral wrap extending from a first end plate and a radially outwardly extending scroll flange;

a second scroll member disposed within said shell, said second scroll member having a second spiral wrap extending from a second end plate, said second scroll wrap being intermeshed with said first scroll wrap;

an axially compliant mounting structure securing said first scroll member to said shell, said axially compliant mounting structure allowing axial movement of said first scroll member with respect to said second scroll member;

an axial stop disposed on a component of said scroll machine for limiting the axial movement of said first scroll member in a direction away from said second scroll member;

a housing attached to said shell;

a sleeve guide disposed in an opening defined by said scroll flange;

a bolt extending through said sleeve guide to secure said sleeve guide to said housing, said shell engaging said bolt, said bolt comprising said axial stop.

* * * * *